US006110879A

United States Patent [19]

Kramer et al.

[11] Patent Number: 6,110,879

[45] **Date of Patent: *Aug. 29, 2000**

[54] AUTOMATIC TRANSMISSION FLUID COMPOSITION

[75] Inventors: David C. Kramer, San Anselmo; John A. Zakarian, Kensington; Jay M. Peterson, Vacaville; Russell R. Krug, Novato; Jaime Lopez, Benicia; Stephen K. Lee, Oakland; Mark L. Sztenderowicz, San Francisco; Joseph M. Pudlak, Vallejo, all of Calif.

[73] Assignee: Chevron U.S.A. Inc., San Francais, Calif.

[ * ] Notice: This patent is subject to a terminal disclaimer.

[21] Appl. No.: 09/173,403

[22] Filed: Oct. 15, 1998

[51] Int. Cl.[7] ..... C10M 145/14

[52] U.S. Cl. ..... 508/469; 252/79

[58] Field of Search ..... 528/469

[56] References Cited

U.S. PATENT DOCUMENTS

| | | | |
|---|---|---|---|
| 3,226,339 | 12/1965 | Frilette et al. | 252/455 |
| 3,236,761 | 2/1966 | Rabo et al. | 208/111 |
| 3,237,762 | 3/1966 | Rabo et al. | 208/111 |
| 3,373,109 | 3/1968 | Frilette et al. | 252/455 |
| 3,620,960 | 11/1971 | Kozlowski et al | 208/60 |
| 3,852,207 | 12/1974 | Stangeland et al. | 208/58 |
| 3,904,513 | 9/1975 | Fisher et al. | 208/264 |
| 3,915,871 | 10/1975 | Bryer et al. | 252/33.6 |
| 4,157,294 | 6/1979 | Iwao et al. | 208/264 |
| 4,181,598 | 1/1980 | Gillespie et al. | 208/58 |
| 4,202,996 | 5/1980 | Hilfman | 585/377 |
| 4,397,827 | 8/1983 | Chu | 423/326 |
| 4,440,781 | 4/1984 | Benecke et al. | 424/285 |
| 4,537,754 | 8/1985 | Casci et al. | 423/277 |
| 4,593,138 | 6/1986 | Casci et al. | 585/481 |
| 4,631,267 | 12/1986 | Lachman et al. | 502/439 |
| 4,631,268 | 12/1986 | Lachman et al. | 502/439 |
| 4,637,995 | 1/1987 | DeAngelis et al. | 502/439 |
| 4,657,880 | 4/1987 | Lachman et al. | 502/64 |
| 4,673,487 | 6/1987 | Miller | 208/58 |
| 4,710,485 | 12/1987 | Miller | 502/213 |
| 4,910,006 | 3/1990 | Zones et al. | 423/328 |
| 4,921,594 | 5/1990 | Miller | 208/58 |
| 5,053,373 | 10/1991 | Zones | 502/64 |
| 5,149,421 | 9/1992 | Miller | 208/114 |
| 5,316,753 | 5/1994 | Nakagawa | 423/706 |
| 5,430,000 | 7/1995 | Timken | 502/60 |
| 5,520,832 | 5/1996 | Alexander | 252/56 R |
| 5,591,322 | 1/1997 | Zones et al. | 208/120 |
| 5,888,946 | 3/1999 | Zakarian et al. | 508/469 |

OTHER PUBLICATIONS

Jean–Phillipe Andre et al., "An Economical Route to High Quality Lubricants", 1996 NPRA Annual Meeting, Mar. 17–19, 1996, San Antonio, Texas, Paper No. AM–96–38.

Communication from European Patent Office dated Jan. 28, 2000.

*Primary Examiner*—Ellen M. McAvoy
*Attorney, Agent, or Firm*—Ernest A. Schaal

[57] ABSTRACT

The present invention provides for a lubricating composition including: a hydrocracker-derived, highly naphthenic, low viscosity index mineral oil; from about 2 wt. % to about 14 wt. % of at least one polymethacrylate polymer; and from about 2 wt. % to about 14 wt. % of a performance additive package. The hydrocracker-derived, highly naphthenic, low viscosity index mineral oil is prepared by: (1) passing a first bottoms portion including not more than about 67 wt. % of a fuels hydrocracker bottoms recycle stream to a dewaxing zone; and (2) passing a second bottoms portion including at least about 33 wt. % of the recycle stream back to the fuels hydrocracker for additional processing; and where the recycle stream has a viscosity at 100° C. of less than about 4.0; (3) contacting the first bottoms portion with a dewaxing catalyst under catalytic dewaxing conditions, where at least a portion of the hydrocracker bottoms is substantially dewaxed; and (4) contacting at least a portion of the substantially dewaxed hydrocracker bottoms with a hydrofinishing catalyst under hydrofinishing conditions, thereby producing a hydrofinished, dewaxed hydrocracker bottoms; and removing from the hydrofinished, dewaxed hydrocracker bottoms at least one light fraction including diesel or jet fuel range material, thereby leaving a heavy fraction including the hydrocracker-derived, highly naphthenic, viscosity index mineral oil having a naphthenes content of at least about 33 wt. %. The lubricating composition has an unsheared kinematic viscosity at 100° C. of at least about 7.3 centistokes; a sheared kinematic viscosity at 100° C. of at least about 6.8 centistokes, where shear is measured by the 20-hour KRL method; and a Brookfield viscosity at −40° C. of no greater than about 10,000 centipoise.

41 Claims, No Drawings

AUTOMATIC TRANSMISSION FLUID COMPOSITION

I. FIELD OF THE INVENTION

The present invention relates to a lubricating composition. More specifically, the invention relates to an automatic transmission fluid composition having high performance at low and high temperatures.

II. BACKGROUND OF THE INVENTION

Automatic transmission fluids are lubricants used in motor vehicle transmissions. Different types of automatic transmission fluids are used depending on the design and severity of application. Generally, automatic transmission fluids are designed to meet specific manufacturer requirements.

An automatic transmission is composed of a complex variety of mechanical parts which operate at close tolerances. The purpose of automatic transmission fluid is to lubricate these close-fitting parts to reduce wear and keep down temperature due to friction. To perform this function, the automatic transmission fluid must maintain its viscosity within certain specifications. Achieving this function is complicated by the changing temperatures under which the transmission is operated. It is desirable that an automatic transmission fluid perform well in all the various temperature conditions under which the transmission will operate.

For example, in a Northern location, the automatic transmission fluid may be below 32° F. prior to use and then heat up to over 300° F. during use. Mineral oil based lubricating oils typically have higher viscosities at lower temperatures and lower viscosities at higher temperatures. As automatic transmissions evolve, however, the maximum viscosity at low temperatures is reduced since too viscous an automatic transmission fluid will not adequately flow as needed to actuate the hydraulic valves and other hydraulic mechanisms of the automatic transmission. Automobile manufacturers have recently changed their specifications for automatic transmission fluid to require lower maximum viscosities at low temperatures. The next generation automatic transmissions will require next generation automatic transmission fluids, especially to be sure the automatic transmission fluid flows adequately at low temperatures. For example, new generation automatic transmission fluids must have Brookfield viscosities at −40° C. of less than 10,000 cP, 13,000 cP, or 17,500 cP. Current requirements for automatic transmission fluids typically only require a Brookfield viscosity at −40° C. of less than 20,000 cP.

Synthetic lubricants made from polyalphaolefins ("PAO's") and some new unconventional high viscosity index mineral base oils can be used to meet these new viscometric requirements. However, those are expensive to manufacture. It would be advantageous to have a relatively inexpensive mineral oil-based lubricant that can lower the cost of meeting the new viscometric requirements. The lubricating composition of the present invention meets this need.

III. SUMMARY OF THE INVENTION

The present invention provides for a lubricating composition including: (1) a major amount of a base oil mixture including: from about 0 wt. % to about 90 wt. % of a first mineral oil selected from a high viscosity index mineral oil, a conventional low viscosity index mineral oil, and mixtures thereof; and from about 10 wt. % to about 100 wt. % of a second mineral oil including a hydrocracker-derived, highly naphthenic, low viscosity index mineral oil; from about 2 wt. % to about 14 wt. % of at least one polymethacrylate polymer; and from about 2 wt. % to about 14 wt. % of a performance additive package.

The hydrocracker-derived, highly naphthenic, low viscosity index mineral oil is prepared by: (1) passing a first bottoms portion including not more than about 67 wt. % of a fuels hydrocracker bottoms stream to a dewaxing zone; and (2) passing a second bottoms portion including at least about 33 wt. % of the bottoms stream back to the fuels hydrocracker for additional processing; and where the bottoms stream has a viscosity at 100° C. of less than about 4.0 cSt; (3) contacting the first bottoms portion with a dewaxing catalyst under catalytic dewaxing conditions, where at least a portion of the hydrocracker bottoms is substantially dewaxed; (4) contacting at least a portion of the substantially dewaxed hydrocracker bottoms with a hydrofinishing catalyst under hydrofinishing conditions, thereby producing a hydrofinished, dewaxed hydrocracker bottoms; and removing from the hydrofinished, dewaxed hydrocracker bottoms at least one light fraction including diesel or jet fuel range material, thereby leaving a heavy fraction including the hydrocracker-derived, highly naphthenic, viscosity index mineral oil having a naphthenes content of at least about 33 wt.%.

The lubricating composition has an unsheared kinematic viscosity at 100° C. of at least about 7.3 centistokes; a sheared kinematic viscosity at 100° C. of at least about 6.8 centistokes, where shear is measured by the 20-hour KRL method; and a Brookfield viscosity at −40° C. of no greater than about 10,000 centipoise.

IV. DETAILED DESCRIPTION OF PREFERRED EMBODIMENTS

A. Viscometric Performance Specifications

The automatic transmission fluid compositions of the invention preferably meet one or more of the viscometric property sets given in Tables 1–4 below. These viscometric performance specifications are from actual specifications, or composites thereof, of automobile manufacturers for the next generation automatic transmission fluids.

TABLE 1

| Property | Target Value | Method of Measurement |
|---|---|---|
| Unsheared Kinematic Viscosity at 100° C. | ≧7.3 cSt. | ASTM D-445 |
| Sheared Kinematic Viscosity at 100° C. | ≧6.8 cSt. | Shear: CEC L-45-T-93. (20 hr. KRL Method) Vis: ASTM D-445 |
| Brookfield Viscosity at −40° C. | ≦10,000 centipoise | ASTM D-2983 |

TABLE 2

| Property | Target Value | Method of Measurement |
|---|---|---|
| Unsheared Kinematic Viscosity at 100° C. | ≧6.5 cSt. | ASTM D-445 |
| Sheared Kinematic Viscosity at 100° C. | ≧6.5 cSt. | Shear: CEC L-45-T-93. (20 hr. KRL Method) Vis: ASTM D-445 |
| Brookfield Viscosity at −40° C. | ≦17,500 centipoise | ASTM D-2983 |

TABLE 3

| Property | Target Value | Method of Measurement |
|---|---|---|
| Unsheared Kinematic Viscosity at 100° C. | ≧6.8 cSt. | ASTM D-445 |
| Sheared Kinematic Viscosity at 100° C. | ≧6.8 cSt. | Shear: ASTM D-5275. (FISST Method, 40 passes) Vis: ASTM D-445 |
| Brookfield Viscosity at −40° C. | ≦13,000 centipoise | ASTM D-2983 |

TABLE 4

| Property | Target Value | Method of Measurement |
|---|---|---|
| Unsheared Kinematic Viscosity at 100° C. | ≧7.3 cSt. | ASTM D-445 |
| Sheared Kinematic Viscosity at 100° C. | ≧6.5 cSt. | Shear: CEC L-45-T-93. (20 hr. KRL Method) Vis: ASTM D-445 |
| Brookfield Viscosity at −40° C. | ≦10,000 centipoise | ASTM D-2983 |

B. Base Oils

1. Low Viscosity Index Base Oil From Processed hydrocracker Bottoms a. Hydrocracker Bottoms The lubricating composition of the invention includes a hydrocracker-derived, highly naphthenic, low viscosity index mineral oil. The term "low viscosity index" mineral oil as used in this specification and appended claims means mineral oils having viscosity indexes lower than as set forth below in the section on "high viscosity index" mineral oils. This hydrocracker-derived, highly naphthenic, low VI mineral oil is prepared by catalytically dewaxing and hydrofinishing a hydrocracker bottoms fraction.

The meaning of the term "hydrocracker bottoms fraction" is generally known to those skilled in the art. Generally, a hydrocracker bottom fraction has a boiling point range from about 470° F. to about 910° F., e.g., where about 5 wt. % boils at or below about 530° F. and, e.g., where 50 wt. % boils at or below about 675° F. Catalytic dewaxing and hydrofinishing, other than as utilized in the lubricating composition of this invention, are known generally to those skilled in the art. Catalytic dewaxing and hydrofinishing are taught, e.g., in U.S. Pat. Nos. 5,591,322; 5,149,421; and 4,181,598, the disclosures of which are incorporated herein by reference.

In fuel hydrocracker processes, certain fractions from the main or vacuum distillation columns for distilling crude oil are catalytically cracked to obtain fuels-range molecules. The heaviest fraction, i.e., the bottoms, from the hydrocracker is typically too heavy for fuels use. It is normally recycled to the hydrocracker feed for further cracking. The hydrocracker bottoms are typically also too light for lubrication uses, although this is not always true for "once-through" units. Typically, however, hydrocrackers operated to make fuels will "recycle to extinction" in order to maximize the fuels product output. In the dewaxing step of the invention, at least a portion of this bottoms fraction recycle stream is passed to a catalytic dewaxing process.

Not more than about 67 wt. % of the recycle stream is passed to the dewaxing unit. Preferably, not more than about 50 wt. % or not more than 33 wt. % of the recycle stream is passed to the dewaxing unit. Thus, at least about 33 wt. %, or preferably at least about 50 wt. % or about 67 wt. %, of the recycle stream is combined with the hydrocracker feed or otherwise returned to the hydrocracker for additional cracking/processing. The bottoms fraction in the recycle stream has a viscosity at 100° C. which is typical of a hydrocracker operated in a manner for maximizing production of jet fuel and/or gasoline. Typically, such viscosity at 100° C. is less than about 4.0 cSt and preferably less than about 3.5 cSt or 3.3 cSt. After catalytic dewaxing and catalytic hydrofinishing, the base oil has a naphthenes content of at least 23 wt. % or 25 wt. %, preferably at least 33 wt. %, 35 wt. %, or 37 wt. %. The term "naphthenes content" as used in this specification, including the claims, means as measured by ASTM D-3238. To meet these special parameters, the hydrocracker will typically need to be operated in a manner typically consistent with optimizing fuels production.

This is in contrast to a hydrocracker operated specifically for lubes production. A hydrocracker operated specifically for lubes production would have no recycle to the hydrocracker feed, a higher viscosity of the bottoms, and lower naphthenes content. This is because further cracking of the molecules reduces viscosity and molecular weight down to levels which are undesirable for lubes. It has been unexpectedly discovered, however, that using hydrocracker bottoms from a fuels hydrocracker operated primarily for fuels production gives unexpectedly useful properties to the bottoms, especially when mixed with other base oils and with VI improvers.

In that process, the bottoms fraction is contacted with an, optionally, conventional dewaxing catalyst at catalytic dewaxing conditions, whereby at least a portion of the bottoms fraction is dewaxed. At least a portion of the resulting dewaxed effluent from the catalytic dewaxing process is then passed to catalytic hydrofinishing process for removal of sulfur, nitrogen, and aromatics. In the hydrofinishing process, the dewaxed effluent from the catalytic dewaxing process is contacted with an, optionally, conventional hydrofinishing catalyst at catalytic hydrofinishing conditions, whereby at least a portion of the sulfur, nitrogen, and/or aromatics is removed.

The hydrofinished effluent is then fractionated by any conventional fractionation process, thereby producing at least one lighter fraction and one heavier fraction. At least a portion of the lighter fraction is high purity, low pour point diesel fuel/jet fuel. At least a portion of the heavier fraction is a hydrocracker-derived, highly naphthenic, low viscosity index base oil for use in the automatic transmission fluid of this invention.

b. Catalytic Dewaxing

The dewaxing process is conducted at catalytic dewaxing conditions. Such conditions are known and are taught for example in U.S. Pat. Nos. 5,591,322; 5,149,421; and 4,181,598, the disclosures of which are incorporated herein by reference. The catalytic dewaxing conditions are dependent in large measure on the feed used and upon the desired pour point. Hydrogen is preferably present in the reaction zone during the catalytic dewaxing process. The hydrogen to feed ratio, i.e., hydrogen circulation rate, is typically between about 500 and about 30,000 SCF/bbl (standard cubic feet per barrel), preferably about 1000 to about 20,000 SCF/bbl. Generally, hydrogen will be separated from the product and recycled to the reaction zone.

Catalyst bed arrangements suitable for use in dewaxing step of the invention are any conventional catalyst bed configuration. The catalytic dewaxing conditions employed depend on the feed used and the desired pour point.

Generally, the process conditions for dewaxing processes are as follows: the temperature is from about 200° C. and about 475° C., preferably between about 250° C. and about 450° C. The pressure is typically from about 15 psig and about 3000 psig, preferably between about 200 psig and 3000 psig. The liquid hourly space velocity (LHSV) preferably will be from 0.1 to 20, preferably between about 0.2 and 10.

Hydrogen is preferably present in the reaction zone during the process. The hydrogen to feed ratio is typically between about 500 and about 30,000 SCF/bbl (standard cubic feet per barrel), preferably from about 1000 to about 20,000 SCF/bbl. Generally, hydrogen will be separated from the product and recycled to the reaction zone.

Suitable aluminosilicate zeolite dewaxing catalysts for use in the dewaxing step of the invention include, e.g., ZSM-48, SSZ-32, other dewaxing-capable zeolites, and mixtures thereof. These are taught in R. Szostak, *Handbook of Molecular Sieves* (Van Norstrand Reinhold 1992), at pages 551–553 and 172–174, which are incorporated herein by reference, and in U.S. Pat. Nos. 5,053,373; 4,397,827; 4,537,754; and 4,593,138, the disclosures of which are incorporated herein by reference. Where two or more zeolite catalysts are employed, they are mixed in an effective weight ratio to enhance dewaxing. Preferred ratios for two zeolites are from about 1:5 to about 20:1.

Any zeolite used in the process may optionally contain a hydrogenation component of the type commonly employed in dewaxing catalysts. See the aforementioned U.S. Pat. No. 4,910,006 and U.S. Pat. No. 5,316,753 for examples of these hydrogenation components, the disclosures of which are incorporated herein by reference.

The hydrogenation component is present in an effective amount to provide an effective hydrodewaxing catalyst preferably in the range of from about 0.01 to 10% by weight, more preferably from about 0.05 to 5% by weight. The catalyst system may be run in such a mode to increase dewaxing at the expense of cracking reactions.

Layered catalyst systems also may be used. For example, the catalyst system may have a first layer including, e.g., zeolite SSZ-32, and at least one Group VIII metal, and a second layer comprising another aluminosilicate zeolite, e.g., one which is more shape selective than zeolite SSZ-32. The use of layered catalysts is disclosed in U.S. Pat. No. 5,149,421, issued Sep. 22, 1992 to Miller, which is incorporated by reference herein in its entirety. The layering may also include a shape-selective molecular sieve bed, e.g., SSZ-31, SSZ-32, SSZ-41, SSZ-43, ZSM-5, ZSM-12, SAPO-11, SAPO-31, SAPO40, SAPO-41, UDT-1, layered with a different component designed for either hydrocracking or hydrofinishing, or any other catalyst having dewaxing activity with bright stocks. Intimately mixed catalyst systems represent another useful variant on this concept.

The aluminosilicate zeolite catalyst preferably contains one or more Group VIII metals or other transition metals, such as platinum, palladium, molybdenum, nickel, vanadium, cobalt, tungsten, zinc, and mixtures thereof. More preferably, the intermediate pore size aluminosilicate zeolite catalyst contains at least one Group VIII metal selected from the group consisting of platinum and palladium. Most preferably, the intermediate pore size aluminosilicate zeolite catalyst contains platinum.

The amount of metal ranges from about 0.01% to about 10% by weight of the molecular sieve, preferably from about 0.2% to about 5%, based on the weight of the molecular sieve. The techniques of introducing catalytically active metals to a molecular sieve are disclosed in the literature, and pre-existing metal incorporation techniques and treatment of the molecular sieve to form an active catalyst such as ion exchange, impregnation or occlusion during sieve preparation are suitable for use in the present process. Such techniques are disclosed in U.S. Pat. Nos. 3,236,761; 3,226,339; 3,236,762; 3,620,960; 3,373,109; 4,202,996; 4,440,781 and 4,710,485, the disclosures of which are incorporated herein by reference.

Catalysts useful in the dewaxing step typically comprise an active material and a support or binder. The support for the catalysts of this invention may be the same as the active material and further can be a synthetic or naturally occurring substance as well as an inorganic material such as clay, silica and/or one or more metal oxides. The latter may be either naturally occurring or in the form of gelatinous precipitates or gels including mixtures of silica and metal oxides.

Naturally occurring clays which can be used as support for the catalysts include those of the montmorillonite and kaolin families, which families include the subbentonites and the kaolins commonly known as Dixie, McNamee, Georgia and Florida clays or others in which the main mineral constituent is halloysite, kaolinite, dickite, nacrite or anauxite. Such clays can be used in the raw state as originally mined or initially subjected to calcination, acid treatment or chemical modification. In addition to the foregoing materials, the catalysts used in the dewaxing step of this invention may be supported on a porous binder or matrix material, such as titania, zirconia, silica-magnesia, silica-zirconia, silica-thoria, silica-berylia, silica-titania, titania-zirconia, as well as a ternary compound such as silica-magnesia-zirconia. A mixture of these components could also be used.

The support may be in the form of a cogel. One binder that is suitable is a low acidity titania prepared from a mixture comprising a low acidity titanium oxide binder material and an aqueous slurry of titanium oxide hydrate. Other binders include alumina and alumina-containing materials such as silica-alumina, silica-alumina-thoria, silica-alumina-zirconia, and silica-alumina-magnesia. Typical aluminas include alpha (alpha) alumina, beta (beta) alumina, gamma (gamma) alumina, chi-eta-rho (chi, eta, rho) alumina, delta (delta) alumina, theta (theta) alumina, and lanthanum beta (beta) alumina. The preferred support is one that is a high surface area material that also possesses a high temperature stability and further possesses a high oxidation stability.

The binder may be prepared according to U.S. Pat. No. 5,430,000, incorporated by reference herein, or may be prepared according to methods disclosed in U.S. Pat. Nos. 4,631,267; 4,631,268; 4,637,995; and 4,657,880, each incorporated by reference herein. Also, the catalysts described herein may be combined with any of the binder precursors described in the above patents, and then may be formed, such as by extrusion, into the shape desired, and then finished in a humidified atmosphere as hereinafter described.

c. Hydrofinishing

The mild hydrogenation step, hydrofinishing step, is beneficial in preparing an acceptably stable hydrocracker-derived, highly naphthenic, low VI base oil since unsaturated products tend to be unstable to air and light and tend to degrade. Hydrofinishing is typically conducted at temperatures ranging from about 190° C. to about 340° C., at pressures of from about 400 psig to about 3000 psig, at space velocities (LHSV) of from about 0.1 to about 20, and hydrogen recycle rates of from about 400 to about 15000 SCF/bbl. The hydrogenation catalyst employed must be active enough not only to hydrogenate the olefins and diolefins within the lube oil fractions, but also to reduce the content of any aromatics (color bodies) present.

Suitable hydrogenation catalysts include conventional, metallic hydrogenation catalysts, particularly the Group VIII metals such as cobalt, nickel, palladium and platinum. The metals are typically associated with carriers such as bauxite, alumina, silica gel, silica-alumina composites, and crystalline aluminosilicate zeolites and other molecular sieves. Palladium, platinum, and mixtures thereof are particularly preferred hydrogenation metals. If desired, non-noble Group VIII metals can be used with molybdates or tungstates. Metal oxides, e.g., nickel/cobalt promoters, or sulfides can be used. Suitable catalysts are disclosed in U.S. Pat. Nos. 3,852,207; 4,157,294; 4,921,594; 3,904,513 and 4,673,487, the disclosures of which are incorporated herein by reference.

2. High Viscosity Index Base Oil

The lubricating oil base oil mixture of the invention contains one or more high viscosity index mineral oils. Such high viscosity index mineral oils are paraffinic. The terms "high viscosity index" mineral oil and "unconventional mineral base oil" do not have strict definitions. In general, they refer to mineral base oils having desirable viscometric properties not typically found in mineral oils and generally only available in expensive synthetic base oils. The marketplace recognizes the desirability of viscometric properties of high-viscosity index and unconventional mineral oils in that they command a higher price than "conventional" mineral oils. Thus, the relative price is also an indicator of unconventional and high viscosity base index oils. To avoid ambiguity, the term "high viscosity index" mineral oil as used in this specification and appended claims means (1) a viscosity index of at least 90 for a mineral oil having a viscosity of 3.0 centistokes at 100° C.; (2) a viscosity index of at least 105 for a mineral oil having a viscosity of 4 centistokes at 100° C.; (3) a viscosity index of at least 115 for a mineral oil having a viscosity of 5.0 centistokes at 100° C.; and (4) a viscosity index of at least 120 for a mineral oil having a viscosity of 7.0 centistokes at 100° C. "High" viscosity indices for other viscosities between 3.0 and 7.0 can be determined by conventional interpolation.

The viscosity indices of the high VI base oils used in the present invention are much higher than those commonly used in the industry. The "high viscosity index" base oils used in the present invention are also referred to as "Unconventional Base Oils". The preferred method of manufacture for the Unconventional Base Oils is a combination of hydrocracking followed by catalytic dewaxing. Two such processes for preferred base oil manufacture are licensed under the names of ISOCRACKING and ISODEWAXING.

3. Other Low Viscosity Index Base Oil

One or more embodiments of the invention include a conventional low viscosity index mineral oil, i.e., one other than the hydrocracker-derived, highly naphthenic, low VI base oil discussed above. The term "conventional" as used in this specification means previously known or used in the lubes art.

Preferred embodiments of the lubricating composition of the invention contain one high VI mineral oil and one low VI mineral oil, where the low VI mineral oil is obtained from hydrocracker bottoms as described above. In one embodiment, the high viscosity index mineral oil has a viscosity of at least about 5.0 cSt at 100° C. The low VI mineral oil has a viscosity of at least about 3.0 cSt at 100° C. More preferably, the high viscosity index mineral oil has a viscosity of at least about 6.5 cSt at 100° C. and the low viscosity index mineral oil has a viscosity of at least 3.7 cSt at 100° C. The weight ratio of the high VI mineral oil to the low VI mineral oil is from about 0:100 to about 90:10, preferably from about 80:20 to about 20:80, or from 70:30 to about 30:70, or from about 60:40 to about 40:60.

The base oil mixture of the invention provides for good low temperature performance while maintaining a minimum oil film thickness to protect moving parts such as bearings and gears. The low VI mineral oil component enables the finished oil to achieve a low pour point and a maximum Brookfield viscosity as set forth in the respective viscometric performance specifications shown in Tables 1–4 above. The high VI mineral oil component provides the necessary oil film thickness to protect moving parts at high temperatures. Neither base oil component alone would impart all season properties to the finished oil.

The viscosity index improver is one component or, optionally, a blend of two or more components. The VI improvers optionally have a shear stability index of less than about 30. The terms "sheared", "shear stability index (SSI)", and "shear stability" as used in this specification and appended claims each mean as measured by the Sonic Shear Method as set forth in ASTM Test D-5621. The shear stability index is calculated as follows:

$$SSI=(Vi-Vf)*100/(Vi-Vb),$$

where Vi is the initial viscosity in centistokes at 100° C. of the fresh, unsheared automatic transmission fluid; Vf is the final viscosity in centistokes at 100° C. of the automatic transmission fluid after the 40-minute D-5621 shear procedure; and Vb is the viscosity in centistokes at 100° C. of the automatic transmission fluid base mixture without the viscosity index improvers added.

The total VI improver content is from about 2 to 14 wt. %. The VI improver(s), whether present individually or in combination, are present in sufficient amounts so that said automatic transmission fluid composition has the viscometric properties of one or more of the sets of viscometric performance specifications shown in Tables 1–4 above.

Polymethacrylate viscosity index improvers are commercially available. The lubricating composition will typically include a performance additive package. The term "performance additive package" as used in this specification and appended claims means any combination of other conventional additives for lubricating compositions. Such additives include corrosion and rust inhibitors, anti-oxidants, dispersants, detergents, anti-foam agents, anti-wear agents, friction modifiers and flow improvers. Such additives are described in "Lubricants and Related Products" by Dieter Klamann, Verlag Chemie, Deerfield Beach, Fla., 1984.

V. ILLUSTRATIVE EMBODIMENTS

The invention will be further clarified by the following Illustrative Embodiments, which are intended to be purely exemplary of the invention. The results are shown in Tables 5 to 10 below.

The components used to blend the various automatic transmission fluid compositions for the Illustrative Embodiments and Comparative Examples are shown below:

"Low VI Base Oil $A_1$ and $A_2$"—are hydrocracker-derived, highly naphthenic, low viscosity index base oils prepared from a hydrocracker bottoms according to the steps of the invention. Low VI Base Oils $A_1$ had a viscosity of about 3:3 cSt at 100° C. and a viscosity index of 83. Low VI Base Oils $A_2$ had a viscosity of about 3.3 cSt at 100° C. and a viscosity index of 86.

"Low VI Base Oil B"—a conventional low viscosity index mineral base oil having a viscosity of about 4.1 cSt at 100° C. and a viscosity index of 99.

"High VI Base Oil A"—a high viscosity index mineral base oil having a viscosity of about 4.2 cSt at 100° C. and a viscosity index of 129.

"High VI Base Oil B"—a high viscosity index mineral base oil having a viscosity of about 5.6 cSt at 100° C. and a viscosity index of 117.

"VI Improvers A, B, and C"—are commercially available polymethacrylate viscosity index improvers.

"Performance Additive Packages A and B"—a commercially available additive package containing such components as anti-wear agent, detergent, anti-rust agent, copper corrosion inhibitor, antioxidant, friction modifier, pour point depressant and anti-foam.

TABLE 5

Lubricating Compositions According to the Invention: Effects of Mixing Low Viscosity Index Base Oils $A_1$ and B

| Run Number → | #1 | #2 | #3 | #4 |
|---|---|---|---|---|
| Lubricating Composition Components (wt. %) | | | | |
| Low Viscosity Index Base Oil $A_1$ | | 20.36 | 28.55 | 48.88 |
| Low Viscosity Index Base Oil B | 81.46 | 61.10 | 52.91 | 32.58 |
| High Viscosity Index Base Oil A | | | | |
| High Viscosity Index Base Oil B | | | | |
| Viscosity Index Improver Additive A | 10.44 | 10.44 | 10.44 | 10.44 |
| Performance Additive Package B | 8.10 | 8.10 | 8.10 | 8.10 |
| Product Properties | | | | |
| Viscosity @ 100° C., cSt | 7.677 | 7.424 | 7.319 | 7.002 |
| Viscosity Index | 183 | 185 | 186 | 186 |
| Brookfield Viscosity @ −40° C. | 18,940 | 14,240 | 12,580 | 12,580 |
| Shear Stability | | | | |
| Fresh Viscosity @ 100° C., cSt[1] | 7.677 | 7.424 | 7.319 | 7.002 |
| After-Shear Viscosity @ 100° C., cSt (Sonic Shear Method, ASTM D-5621)[2] | 6.860 | 6.612 | 6.513 | 6.255 |
| Viscosity Change % | −10.6 | −10.9 | −11.0 | −10.7 |
| Meets Viscometric Performance Specifications (Reference to Tables 1–4). | | 2 | 2 | |

[1]Viscosity at 100° C. was calculated from experimentally determined shear stability index.
[2]See Note 1 above.

TABLE 6

Lubricating Compositions According to the Invention: Effects of Mixing Low VI Base Oil $A_1$ With High VI Base Oil A

| Run Number → | #1 | #2 | #3 | #4 |
|---|---|---|---|---|
| Lubricating Composition Components (wt. %) | | | | |
| Low Viscosity Index Base Oil $A_1$ | | 8.15 | 16.29 | 80.45 |
| Low Viscosity Index Base Oil B | | | | |
| High Viscosity Index Base Oil A | 81.46 | 73.31 | 65.17 | |
| High Viscosity Index Base Oil B | | | | |
| Viscosity Index Improver Additive A | 10.44 | 10.44 | 10.44 | 11.45 |
| Performance Additive Package A | 8.10 | 8.10 | 8.10 | 8.10 |
| Product Properties | | | | |
| Viscosity @ 100° C., cSt | 7.511 | 7.447 | 7.320 | 6.995 |
| Viscosity Index | 207 | 206 | 204 | 194 |
| Brookfield Viscosity @ −40° C. | 292,400 | 76,900 | 43,500 | 10,760 |
| Shear Stability | | | | |
| Fresh Viscosity @ 100° C., cSt[3] | 7.511 | 7.447 | 7.320 | 6.995 |
| After-Shear Viscosity @ 100° C., cSt (Sonic Shear Method, ASTM D-5621)[4] | 6.748 | 6.678 | 6.560 | 6.160 |
| Viscosity Change % | −10.2 | −10.3 | −10.4 | −11.9 |
| Meets Viscometric Performance Specifications (Reference to Tables 1–4). | | | | |

[3]See Note 1 above.
[4]See Note 1 above.

TABLE 7

Lubricating Compositions According to the Invention: Effects of Mixing Low VI Base Oil $A_1$ With High VI Base Oil B

| Run Number → | #1 | #2 | #3 |
|---|---|---|---|
| Lubricating Composition Components (wt. %) | | | |
| Low Viscosity Index Base Oil $A_1$ | 50.50 | 65.17 | 80.45 |
| Low Viscosity Index Base Oil B | | | |
| High Viscosity Index Base Oil A | | | |
| High Viscosity Index Base Oil B | 30.95 | 16.29 | |
| Viscosity Index Improver Additive A | 10.44 | 10.44 | 11.45 |
| Performance Additive Package A | 8.10 | 8.10 | 8.10 |
| Product Properties | | | |
| Viscosity @ 100° C., cSt | 7.646 | 7.123 | 6.995 |
| Viscosity Index | 185 | 187 | 194 |
| Brookfield Viscosity @ −40° C. | 13,460 | 12,320 | 10,760 |
| Shear Stability | | | |
| Fresh Viscosity @ 100° C., cSt[5] | 7.646 | 7.123 | 6.995 |

TABLE 7-continued

Lubricating Compositions According to the Invention: Effects of Mixing Low VI Base Oil $A_1$ With High VI Base Oil B

| Run Number → | #1 | #2 | #3 |
|---|---|---|---|
| After-Shear Viscosity @ 100° C., cSt (Sonic Shear Method, ASTM D-5621)[6] | 6.813 | 6.335 | 6.160 |
| Viscosity Change % | −10.9 | −11.1 | −11.9 |
| Meets Viscometric Performance Specifications (Reference to Tables 1–4). | 2 | | |

[5]See Note 1 above.
[6]See Note 1 above.

The results of the Illustrative Embodiments in Tables 5, 6 and 7 show the effects of various mixtures of components. In particular, the effect of adding Low Viscosity Index Base Oil $A_1$ is of interest, i.e., a hydrocracker-derived, highly naphthenic, low VI base oil of the invention. In Table 5, the concentration of Low Viscosity Index Base Oil $A_1$, in mixture with Low Viscosity Index Base Oil B, was steadily increased over 4 test runs. The results show that increasing the concentration of Low Viscosity Index Base Oil $A_1$ resulted in a decreased Brookfield Viscosity at −40° C., increased VI, and decreased Viscosity at 100° C. In Table 5, runs 2 and 3 meet the viscometric performance specifications shown in Table 2 above.

In Table 6 and 7, the concentration of Low Viscosity Index Base Oil $A_1$, in mixture with High Viscosity Index Base Oils A or B, was steadily increased. The results show that increasing the concentration of Low Viscosity Index Base Oil A resulted in a decreased Brookfield Viscosity at −40° C. decreased VI and decreased Viscosity at 100° C.

As shown in Tables 6 and 7, increasing quantities of Low Viscosity Index Base Oil $A_1$ resulted in increased meeting of the target viscometric performance specifications. In Table 7, run 1 meets the target viscometric performance specifications shown in Table 2 above.

TABLE 8

Naphthenes Content

| | Low Viscosity Index Base Oil A | M | N | O | P | Q |
|---|---|---|---|---|---|---|
| | | | | | | |
| Viscometric Properties | | | | | | |
| Kinematic Viscosity, cSt @ 40° C. | 14.70 | 8.879 | 12.23 | 12.23 | 11.98 | 15.36 |
| Kinematic Viscosity, cSt @ 100° C. | 3.289 | 2.471 | 2.907 | 3.11 | 3.02 | 3.408 |
| Viscosity Index | 86 | 101 | 78 | 115 | 107 | 91 |
| API, 60/60 ° F. | 34.2 | 39.3 | | 39.8 | 39.8 | 33.5 |
| Pour Point, ° C. | -33 | -42 | -39 | -22.5 | -42.5 | -21 |
| Paraffins, Naphthenes, and Aromatics Content | | | | | | |
| Paraffinic carbon Cp | 63 | 76 | | 79 | 79 | 63 |
| Naphthenic carbon Cn | 37 | 24 | | 19 | 19 | 34 |
| Aromatic carbon Ca | 0 | 0 | | 2 | 2 | 3 |

Table 8 shows the higher naphthenes content of one embodiment of the hydrocracker-derived, highly naphthenic, low VI mineral base oil of the invention in comparison to other commercially available catalytically dewaxed base oils and one solvent dewaxed base oil. Base oils M, N, O, and P are ATF base oils made from hydrocrackers. Their naphthene content is much lower than in the hydrocracker-derived, highly naphthenic, low VI mineral base oil of the invention. The naphthenes content of base oil Q is close to that of the hydrocracker-derived, highly naphthenic, low VI mineral base oil of the invention. However, base oil Q is a solvent refined ATF base oil and so also has higher aromatics content which is undesirable since that tends to cause poor oxidation stability.

TABLE 9

Comparison Of Viscometric Performance Of The Hydrocracker-Derived, Highly Naphthenic, Low Viscosity Index Base Oil Of The Invention With A Solvent Dewaxed Low Viscosity Index Base Oil Having Similar Naphthenes Content

| Run Number→ | #1 | #2 | #3 | #4 |
|---|---|---|---|---|
| Components | wt. % | Wt. % | wt. % | wt. % |
| Low Viscosity Index Base Oil A[2] | 80.30 | | 80.60 | 80.30 |
| Base Oil Q | | 80.50 | | |
| Performance Additive Package B | 7.70 | 7.70 | 7.70 | 7.70 |
| Viscosity Index Improver Additive A | 12.00 | 11.80 | | |
| Viscosity Index Improver Additive B | | | 11.70 | |
| Viscosity Index Improver Additive C | | | | 12.00 |
| | | | | |
| Total Weight % | 100.00 | 100.00 | 100.00 | 100.00 |
| | | | | |
| Test Name | | | | |
| Viscosity, cSt, 40° C. | 37.96 | 39.40 | 37.76 | 36.22 |
| Viscosity, cSt, 100° C. | 7.882 | 8.105 | 7.903 | 7.564 |
| Viscosity Index | 186 | 186 | 188 | 184 |
| | | | | |
| Brookfield vis, cP @ -40° C. | 18,120 | 34,350 | 15,240 | 13,060 |
| Calculated After-Shear Viscosity @ 100° C., cSt | 6.940 | 7.142 | 6.957 | 6.695 |
| Pour Point, ° C. | -48 | | | |
| Flash Point, COC, ° C. | 194 | | | |
| Meets Viscometric Performance Specification (Reference to Tables 1–4). | | | 2 | 2 |

Table 9 shows how the viscometric performance of the hydrocracker-derived, highly naphthenic, low viscosity index base oil of the invention compares with the viscometric performance of a solvent dewaxed low viscosity index base oil having a similar naphthenes content (i.e., Low VI Oil Q in Table 8). Even though the solvent dewaxed base oil has a similar naphthenes content and has a slightly higher VI and viscosity, its viscometric properties are not as good for making ATF as the hydrocracker-derived, highly naphthenic, low viscosity index base oil of the invention, i.e., a Brookfield viscosity of 18,120 versus 34,350. This is surprising behavior which is believed to be due at least in part to an unexpected beneficial effect of Isocracking and Isodewaxing compared to solvent refining.

If we change the VI Improver, as in runs 3 and 4, we can further improve the viscometric performance of the hydrocracker-derived, highly naphthenic, low viscosity index base oil of the invention so that the Brookfield viscosity meets at least one of our preferred embodiments, i.e., the performance specifications in Tables 1–4 above. As shown, run 1 is very close to meeting the target viscometric performance specifications shown in Table 2 above. In comparison, blend 2, the solvent-dewaxed base oil, is far from it. Blends 3 and 4 each meet the target viscometric performance specifications shown in Table 2 above.

TABLE 10

Comparison Of Viscometric Performance Of The Hydrocracker-Derived, Highly Naphthenic, Low Viscosity Index Base Oil Alone And Mixed In Various Concentrations With An Expensive High Viscosity Index Base Oil

| Run Number → Components | #1 wt. % | #2 wt. % | #3 wt. % | #4 wt. % | #5 wt. % |
|---|---|---|---|---|---|
| Low Viscosity Index Base Oil $A_2$ | 0.00 | 13.00 | 41.15 | 61.40 | 80.60 |
| High VI Base Oil A | 83.80 | 70.50 | 41.15 | 19.90 | 0.00 |
| Performance Additive Package B | 7.70 | 7.70 | 7.70 | 7.70 | 7.70 |
| Viscosity Index Improver Additive B | 8.50 | 8.80 | 10.00 | 11.00 | 11.70 |
| Total Weight % | 100.00 | 100.00 | 100.00 | 100.00 | 100.00 |
| Test Name | | | | | |
| Viscosity, cSt, 40° C. | 34.5 | 34.56 | 35.71 | 36.81 | 37.76 |
| Viscosity, cSt, 100° C. | 7.413 | 7.409 | 7.559 | 7.806 | 7.903 |
| Viscosity Index | 189 | 189 | 187 | 190 | 188 |
| Viscosity after shear, cSt, 100° C. | 6.79 | 6.75 | 6.79 | 6.93 | 6.33 |
| Brookfield vis, cP @ −40° C. | 10,920 | 11,020 | 11,420 | 13,120 | 15,240 |
| Meets Viscometric Performance Specifications (Reference to Tables 1–4). | 2 | 2 | 2 | 2 | 2 |

The results in Table 10 show what was known, i.e., that a high VI oil can make a very good ATF. Table 10 also shows results that were unexpected however. By adding increasing amounts of the hydrocracker-derived, highly naphthenic, low viscosity index base oil of the invention, we can continue to make good ATF. As we add more of the hydrocracker-derived, highly naphthenic, low viscosity index base oil of the invention, we need to use more VI Improver to maintain a satisfactory Brookfield viscosity. Since the manufacturing cost of the high VI base oil is higher than the manufacturing cost of the hydrocracker-derived, highly naphthenic, low viscosity index base oil of the invention, it is unexpected that we can use the hydrocracker-derived, highly naphthenic, low viscosity index base oil of the invention as a blending component to reduce the cost of the finished ATF.

As shown, each blend in Table 10 meets either the target viscometric performance specifications shown in Table 2 above.

What is claimed is:

1. A lubricating composition comprising:

(a) a major amount of a base oil mixture comprising:
  (1) from about 0 wt. % to about 90 wt. % of a first mineral oil selected from a high viscosity index mineral oil, a conventional low viscosity index mineral oil, and mixtures thereof; and
  (2) from about 10 wt. % to about 100 wt. % of a second mineral oil comprising a hydrocracker-derived, highly naphthenic, low viscosity index mineral oil prepared by:
    (i) passing a first bottoms portion comprising not more than about 67 wt. % of a fuels hydrocracker bottoms recycle stream to a dewaxing zone; and passing a second bottoms portion comprising at least about 33 wt. % of said recycle stream back to said fuels hydrocracker for additional processing; and wherein said recycle stream has a viscosity at 100° C. of less than about 4.0;
    (ii) contacting said first bottoms portion with a dewaxing catalyst under catalytic dewaxing conditions, wherein at least a portion of said hydrocracker bottoms is substantially dewaxed;
    (iii) contacting at least a portion of said substantially dewaxed hydrocracker bottoms with a hydrofinishing catalyst under hydrofinishing conditions, thereby producing a hydrofinished, dewaxed hydrocracker bottoms; and
    (iv) removing from said hydrofinished, dewaxed hydrocracker bottoms at least one light fraction comprising diesel or jet fuel range material, thereby leaving a heavy fraction comprising said hydrocracker-derived, highly naphthenic, viscosity index mineral oil having a naphthenes content of at least about 33 wt. %;

(b) from about 2 wt. % to about 14 wt. % of at least one polymethacrylate polymer;

(c) from about 2 wt. % to about 14 wt. % of a performance additive package; and (d) wherein said lubricating composition has:
  (1) an unsheared kinematic viscosity at 100° C. of at least about 7.3 centistokes;
  (2) a sheared kinematic viscosity at 100° C. of at least about 6.8 centistokes, wherein shear is measured by the 20 hour KRL method; and
  (3) a Brookfield viscosity at −40° C. of no greater than about 10,000 centipoise.

2. The lubricating composition of claim 1, further comprising at least two of said polymethacrylate polymers comprising a first polymethacrylate polymer and a second polymethacrylate polymer.

3. The lubricating composition of claim 2, wherein said lubricating composition is an automatic transmission fluid composition.

4. The lubricating composition of claim 1, wherein said polymethacrylate polymer is adapted for viscosity index improvement of a natural lubricating oil.

5. The lubricating composition of claim 3, wherein the weight ratio of said first mineral oil to said hydrocracker-derived, highly naphthenic, low viscosity index mineral oil is from about 80:20 to about 20:80.

6. The lubricating composition of claim 3, wherein the weight ratio of said first mineral oil to said hydrocracker-derived, highly naphthenic, low viscosity index mineral oil is from about 70:30 to about 30:70; and wherein said hydrocracker-derived, highly naphthenic, low viscosity index mineral oil has a naphthenes content of at least about 35 wt. %.

7. The lubricating composition of claim 3, wherein the weight ratio of said first mineral oil to said hydrocracker-derived, highly naphthenic, low viscosity index mineral oil is from about 60:40 to about 40:60.

8. The lubricating composition of claim 2, wherein said lubricating composition contains from about 1 weight percent to about 10 weight percent, based on the weight of said lubricating composition, of one polymethacrylate polymer and a diluent.

9. The lubricating composition of claim 2, wherein said lubricating composition contains from about 1 weight percent to about 10 cumulative weight percent, based on the weight of said lubricating composition, of two polymethacrylate polymer and a diluent.

10. The lubricating composition of claim 3, wherein said first mineral oil consists essentially of said conventional low viscosity index mineral oil.

11. The lubricating composition of claim 1, wherein said first mineral oil consists essentially of said high viscosity index mineral oil, and wherein:

(a) said high viscosity index mineral oil has a kinematic viscosity at 100° C. of at least about 4.0 centistokes; and (b) said hydrocracker-derived, highly naphthenic, low viscosity index mineral oil has a kinematic viscosity at 100° C. of less than about 4.0 centistokes.

12. The lubricating composition of claim 1, wherein said first mineral oil consists essentially of said high viscosity index mineral oil, and wherein:

(a) said high viscosity index mineral oil has a kinematic viscosity at 100° C. of at least about 5.0 centistokes; and (b) said hydrocracker-derived, highly naphthenic, low viscosity index mineral oil has a kinematic viscosity at 100° C. of less than about 3.5 centistokes.

13. The automatic transmission fluid composition of claim 10, wherein said automatic transmission fluid composition contains from about 4 weight percent to about 8 weight percent, based on the weight of said automatic transmission fluid composition, of said first polymethacrylate viscosity index improver.

14. The automatic transmission fluid composition of claim 10, wherein said automatic transmission fluid composition contains from about 2 weight percent to about 5 weight percent, based on the weight of said automatic transmission fluid composition, of said second polymethacrylate viscosity index improver.

15. A lubricating composition comprising:

(a) a major amount of a base oil mixture comprising:

(1) from about 0 wt. % to about 90 wt. % of a first mineral oil selected from the group consisting of a high viscosity index mineral oil, a conventional low viscosity index mineral oil, and mixtures thereof; and (2) from about 10 wt. % to about 100 wt. % of a second mineral oil comprising a hydrocracker-derived, highly naphthenic, low viscosity index mineral oil prepared by:

(i) passing a first bottoms portion comprising not more than about 67 wt. % of a fuels hydrocracker bottoms recycle stream to a dewaxing zone; and passing a second bottoms portion comprising at least about 33 wt. % of said recycle stream back to said fuels hydrocracker for additional processing; and wherein said recycle stream has a viscosity at 100° C. of less than about 4.0;

(ii) contacting said first bottoms portion with a dewaxing catalyst under catalytic dewaxing conditions, wherein at least a portion of said hydrocracker bottoms is substantially dewaxed;

(iii) contacting at least a portion of said substantially dewaxed hydrocracker bottoms with a hydrofinishing catalyst under hydrofinishing conditions, thereby producing a hydrofinished, dewaxed hydrocracker bottoms; and (iv) removing from said hydrofinished, dewaxed hydrocracker bottoms at least one light fraction comprising diesel or jet fuel range material, thereby leaving a heavy fraction comprising said hydrocracker-derived, highly naphthenic, low viscosity index mineral oil having a naphthenes content of at least about 33wt. %;

(b) from about 2 wt. % to about 14 wt. % of at least one polymethacrylate polymer;

(c) from about 2 wt. % to about 14 wt. % of a performance additive package; and (d) wherein said lubricating composition has:

(1) an unsheared kinematic viscosity at 100° C. of at least about 6.5 centistokes;

(2) a sheared kinematic viscosity at 100° C. of at least about 6.5 centistokes, wherein shear is measured by the 20-hr KRL method; and (3) a Brookfield viscosity at −400° C. of no greater than about 17,500 centipoise.

16. The lubricating composition of claim 15, further comprising at least two of said polymethacrylate polymers comprising a first polymethacrylate polymer and a second polymethacrylate polymer.

17. The lubricating composition of claim 16, wherein said lubricating composition is an automatic transmission fluid composition.

18. The lubricating composition of claim 15, wherein said polymethacrylate polymer is adapted for viscosity index improvement of a natural lubricating oil.

19. The lubricating composition of claim 18, wherein the weight ratio of said first mineral oil to said hydrocracker-derived, highly naphthenic, low viscosity index mineral oil is from about 80:20 to about 20:80.

20. The lubricating composition of claim 18, wherein the weight ratio of said first mineral oil to said hydrocracker-derived, highly naphthenic, low viscosity index mineral oil is from about 70:30 to about 30:70; and wherein said hydrocracker-derived, highly naphthenic, low viscosity index mineral oil has a naphthenes content of at least about 35 wt. %.

21. The lubricating composition of claim 18, wherein the weight ratio of said first mineral oil to said hydrocracker-derived, highly naphthenic, low viscosity index mineral oil is from about 60:40 to about 40:60.

22. The lubricating composition of claim 16, wherein said lubricating composition contains from about 1 weight percent to about 10 weight percent, based on the weight of said lubricating composition, of said first polymethacrylate polymer and a diluent.

23. The lubricating composition of claim 18, wherein said first mineral oil consists essentially of said conventional low viscosity index mineral oil.

24. The lubricating composition of claim 15, wherein said first mineral oil consists essentially of said high viscosity index mineral oil, and wherein:

(a) said high viscosity index mineral oil has a kinematic viscosity at 100° C. of at least about 4.0 centistokes; and (b) said hydrocracker-derived, highly naphthenic, low viscosity index mineral oil has a kinematic viscosity at 100° C. of less than about 4.0 centistokes.

25. The lubricating composition of claim 15, wherein said first mineral oil consists essentially of said high viscosity index mineral oil, and wherein:

(a) said high viscosity index mineral oil has a kinematic viscosity at 100° C. of at least about 5.0 centistokes; and (b) said hydrocracker-derived, highly naphthenic, low viscosity index mineral oil has a kinematic viscosity at 100° C. of less than about 3.5 centistokes.

26. The automatic transmission fluid composition of claim 25, wherein said automatic transmission fluid composition contains from about 4 weight percent to about 8 weight percent, based on the weight of said automatic transmission fluid composition, of said first polymethacrylate viscosity index improver.

27. The automatic transmission fluid composition of claim 25, wherein said automatic transmission fluid composition contains from about 2 weight percent to about 5 weight percent, based on the weight of said automatic transmission fluid composition, of said second polymethacrylate viscosity index improver.

28. A lubricating composition comprising:

(a) a major amount of a base oil mixture comprising:

(1) from about 0 wt. % to about 90 wt. % of a first mineral oil selected from the group consisting of a high viscosity index mineral oil, a conventional low viscosity index mineral oil, and mixtures thereof; and (2) from about 10 wt. % to about 100 wt. % of a second mineral oil comprising a hydrocracker-derived, highly naphthenic, low viscosity index mineral oil prepared by:

(i) passing a first bottoms portion comprising not more than about 67 wt. % of a fuels hydrocracker bottoms recycle stream to a dewaxing zone; and passing a second bottoms portion comprising at least about 33 wt. % of said recycle stream back to said fuels hydrocracker for additional processing; and wherein said recycle stream has a viscosity at 100° C. of less than about 4.0;

(ii) contacting said first bottoms portion with a dewaxing catalyst under catalytic dewaxing conditions, wherein at least a portion of said hydrocracker bottoms is substantially dewaxed;

(iii) contacting at least a portion of said substantially dewaxed hydrocracker bottoms with a hydrofinishing catalyst under hydrofinishing conditions, thereby producing a hydrofinished, dewaxed hydrocracker bottoms; and (iv) removing from said hydrofinished, dewaxed hydrocracker bottoms at least one light fraction comprising diesel or jet fuel range material, thereby leaving a heavy fraction comprising said hydrocracker-derived, highly naphthenic, low viscosity index mineral oil having a naphthenes content of at least about 33 wt. %;

(b) from about 2 wt. % to about 14 wt. % of at least one polymethacrylate polymer;

(c) from about 2 wt. % to about 14 wt. % of a performance additive package; and (d) wherein said lubricating composition has:

(1) an unsheared kinematic viscosity at 100° C. of at least about 6.8 centistokes;

(2) a sheared kinematic viscosity at 100° C. of at least about 6.8 centistokes, wherein shear is measured by the FISST method; and (3) a Brookfield viscosity at −40° C. of no greater than about 13,000 centipoise.

29. The lubricating composition of claim 28, further comprising at least two of said polymethacrylate polymers comprising a first polymethacrylate polymer and a second polymethacrylate polymer.

30. The lubricating composition of claim 29, wherein said lubricating composition is an automatic transmission fluid composition.

31. The lubricating composition of claim 29, wherein said polymethacrylate polymer is adapted for viscosity index improvement of a natural lubricating oil.

32. The lubricating composition of claim 31, wherein the weight ratio of said first mineral oil to said hydrocracker-derived, highly naphthenic, low viscosity index mineral oil is from about 80:20 to about 20:80.

33. The lubricating composition of claim 31, wherein the weight ratio of said first mineral oil to said hydrocracker-derived, highly naphthenic, low viscosity index mineral oil is from about 70:30 to about 30:70; and wherein said hydrocracker-derived, highly naphthenic, low viscosity index mineral oil has a naphthenes content of at least about 35 wt. %.

34. The lubricating composition of claim 31, wherein the weight ratio of said first mineral oil to said hydrocracker-derived, highly naphthenic, low viscosity index mineral oil is from about 60:40 to about 40:60.

35. The lubricating composition of claim 30, wherein said lubricating composition contains from about 1 weight percent to about 10 weight percent, based on the weight of said lubricating composition, of said first polymethacrylate polymer and a diluent.

36. The lubricating composition of claim 30, wherein said lubricating composition contains from about I weight percent to about 10 weight percent, based on the weight of said lubricating composition, of said second polymethacrylate polymer and a diluent.

37. The lubricating composition of claim 31, wherein said first mineral oil consists essentially of said conventional low viscosity index mineral oil.

38. The lubricating composition of claim 29, wherein said first mineral oil consists essentially of said high viscosity index mineral oil, and wherein:

(a) said high viscosity index mineral oil has a kinematic viscosity at 100° C. of at least about 4.0 centistokes; and (b) said hydrocracker-derived, highly naphthenic, low viscosity index mineral oil has a kinematic viscosity at 100° C. of less than about 4.0 centistokes.

39. The lubricating composition of claim 29, wherein said first mineral oil consists essentially of said high viscosity index mineral oil, and wherein:

(a) said high viscosity index mineral oil has a kinematic viscosity at 100° C. of at least about 5.0 centistokes; and (b) said hydrocracker-derived, highly naphthenic, low viscosity index mineral oil has a kinematic viscosity at 100° C. of less than about 3.5 centistokes.

40. The automatic transmission fluid composition of claim 38, wherein said automatic transmission fluid composition contains from about 4 weight percent to about 8 weight percent, based on the weight of said automatic transmission fluid composition, of said first polymethacrylate viscosity index improver.

41. The automatic transmission fluid composition of claim 38, wherein said automatic transmission fluid composition contains from about 2 weight percent to about 5 weight percent, based on the weight of said automatic transmission fluid composition, of said second polymethacrylate viscosity index improver.

* * * * *